US005305682A

United States Patent [19]

Kaneko

[11] Patent Number: 5,305,682

[45] Date of Patent: Apr. 26, 1994

[54] PIPING AND WIRING LEAD-OUT MECHANISM FOR RODLESS CYLINDER

[75] Inventor: Junya Kaneko, Soka, Japan

[73] Assignee: SMC Corporation, Tokyo, Japan

[21] Appl. No.: 927,646

[22] PCT Filed: Jan. 10, 1991

[86] PCT No.: PCT/JP91/00012

§ 371 Date: Sep. 10, 1992

§ 102(e) Date: Sep. 10, 1992

[87] PCT Pub. No.: WO92/12351

PCT Pub. Date: Jul. 23, 1992

[51] Int. Cl.[5] ..... F01B 25/26; F01B 29/00; F01B 31/00

[52] U.S. Cl. ..... 92/5 R; 92/88; 92/164

[58] Field of Search ..... 92/5 R, 88, 163, 164

[56] References Cited

U.S. PATENT DOCUMENTS

| | | | |
|---|---|---|---|
| 2,953,118 | 9/1960 | Flick et al. | 92/164 |
| 3,511,136 | 5/1970 | Thomas et al. | 92/163 |
| 5,103,172 | 4/1992 | Stoll | 92/5 R |

FOREIGN PATENT DOCUMENTS

| | | |
|---|---|---|
| 62-59307 | 4/1987 | Japan . |
| 64-45009 | 3/1989 | Japan . |
| 1-132804 | 9/1989 | Japan . |

OTHER PUBLICATIONS

*Tol-O-Matic* Sales brochure pp. 10–11 Mar. 1987.

*Primary Examiner*—Thomas E. Denion

*Attorney, Agent, or Firm*—Oblon, Spivak, McClelland, Maier & Neustadt

[57] ABSTRACT

In a rodless cylinder having a piston fitted in a cylinder body for reciprocating movement therein, and a moving member to be moved back and forth along the cylinder body in synchronism with the piston, there is provided a piping and wiring lead-out mechanism which permits the orientation in an arbitrary direction of not only the pipes of operating fluid pressure to and from pressure chambers of the cylinder but also of the lead wires of a piston position sensor switch. For these purposes, ports are opened on the lateral side, outer end and lower side of each of end plates provided at the opposite ends of the cylinder body to supply operating fluid pressure separately to a pair of pressure chambers in the cylinder. The ports to one pressure chamber are communicated with each other through passages provided in the end plate and cylinder body, while a groove is provided along an outer surface of the cylinder body for mounting a switch or switches thereon. A wire lead-out member with a plural number of wire lead-out holes is relocatably fixed in an arbitrary position in the longitudinal direction of the groove.

1 Claim, 7 Drawing Sheets

PIPING AND WIRING LEAD-OUT MECHANISM FOR RODLESS CYLINDER

FIELD OF THE ART

This invention relates to a piping/wiring lead-out mechanism which facilitates piping of fluid pressure conduits as well as wiring of switch lead wires to and from a rodless cylinder.

STATE OF THE ART

In a conventional rod type hydraulic cylinder with a piston rod, a driven part is attached to the fore end of a piston rod which is projected out of a fluid cylinder body. Therefore, the piston driving fluid pipes which are connected to a cover at the head end of the cylinder body are unlikely to become an obstacle to the movement of the driven part. The same applies to the lead wires of a piston sensor switch which is usually provided on a lateral side of a cylinder body for the purpose of stopping the piston in a predetermined position or for other purposes.

However, in a rodless cylinder as disclosed, for example, in U.S. Pat. No. 4,545,290 and Japanese Laid-Open Utility Model Application 64-45009, a moving member which is slid back and forth along a cylinder body is arranged to pass closely to piping and wiring components in the course of its movement, so that the operation of the moving member is very likely to be obstructed by a piston driving fluid piping which is connected to a particular position of a cover member at the head or rod end of the cylinder body or by the lead wires of a piston position sensor switch which are drawn out of the cylinder body in a random fashion.

With regard to lead wires of a piston sensor switch, it is conceivable to provide a groove longitudinally on a lateral side of a cylinder body and to mount the switch in the groove along with its lead wires in such a way that the lead wires can be drawn out through one end of the groove. However, this arrangement only permits to draw out the lead wires at one fixed position on the cylinder body, precluding the possibilities of drawing out the lead wires at any other arbitrary position.

SUMMARY OF THE INVENTION

It is a primary object of the present invention to provide a rodless cylinder of a construction which permits to lead out operating fluid pressure pipes and/or lead wires of an electric switch or switches selectively at a position which would not contact and interfere with the movement of a moving member on the cylinder body or of a driven part attached to the moving member.

It is another object of the present invention to provide a wire lead-out mechanism for a rodless cylinder of the sort as mentioned above, the lead-out mechanism permitting to draw out lead wires of a piston position sensor switch at an arbitrary position of the cylinder body and to alter the position at which the switch is to be mounted on the cylinder body.

In accordance with the present invention, for achieving the above-stated objectives, there is provided a piping and wiring lead-out mechanism for a rodless cylinder having a piston fitted in a cylinder body for reciprocating movement therein and a moving member adapted to slide reciprocatingly along the cylinder body in synchronism with the movement of the piston, the lead-out mechanism essentially including: a port opened in each of end plates at the opposite ends of the cylinder to supply fluid pressure to a pair of pressure chambers defined by the piston; each of the end plates having fluid supply ports opened in lateral wall, outer end wall and lower side wall thereof to supply fluid pressure separately to each one of the pressure chambers; the fluid supply ports on each end plate being communicated with each other through passages formed in the end plate and cylinder body; a groove formed longitudinally on a lateral side of the cylinder body to mount and accommodate a switch and switch lead wires thereon; and a wire outlet member having a plural number of lead wire outlet holes in face to face relation with the groove and being relocatably fixed in the groove at an arbitrary position in the longitudinal direction thereof.

With the piping and wiring lead-out mechanism of the above arrangement, the operating fluid can be supplied to a pair of pressure chambers, which are defined by the piston, through one of the ports provided on three perpendiculaly intersecting surfaces of the corresponding end plate.

Accordingly, a pipe can be connected to an optimum port which would not interfare with the movement of the moving member and in consideration of the posture or position of installation of the rodless cylinder or the position of a fluid pressure source.

Besides, the provision of the longitudinal groove on the outer side wall of the cylinder body contributes to mounting a switch on the outer circumferential surface of the cylinder body and to accommodating its lead wires, while permitting to draw out the lead wires at an arbitrary position by the use of the wire lead-out member. Consequently, this arrangement keeps the reciprocating moving member on the cylinder body securely out of contact with the lead wires, and can easily cope with alterations of the switch mounting position.

BRIEF DESCRIPTION OF THE DRAWINGS

In the accompanying drawings:

FIGS. 4 through 7 show the state of communication between ports RA and LA, of which FIG. 4 is a plan view having an intermediate portion of the cylinder cut away for the convenience of illustration, FIG. 5 is a side view, FIG. 6 is a right-hand end view, and FIG. 7 is a left-hand end view;

FIGS. 8 through 11 show the state of communication between RB and LB ports, of which FIG. 8 is a plan view having an intermediate portion of the cylinder cut away for the convenience of illustration, FIG. 9 is a side view, FIG. 10 is a right-hand end view, and FIG. 11 is a left-hand end view; and FIGS. 12 through 16 show an embodiment of the wire lead-out member, of which FIG. 12 is a front view of the lead-out member, FIG. 13 is a back view, FIGS. 14 and 15 are sectional views taken on lines A—A and B—B of FIG. 12, respectively, and FIG. 16 is a sectional view taken on line C—C of FIG. 13.

BEST MODE FOR CARRYING OUT THE INVENTION

Figure 1:
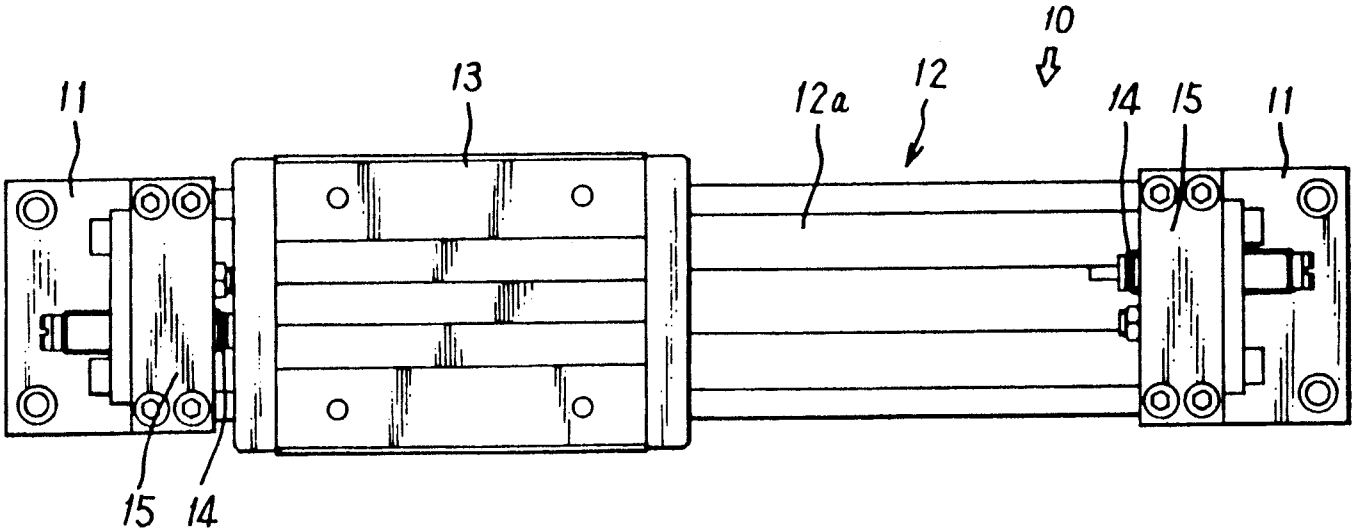
FIG. 1 is a plan view of major components of a rodless cylinder embodying the present invention.
Figure 2:
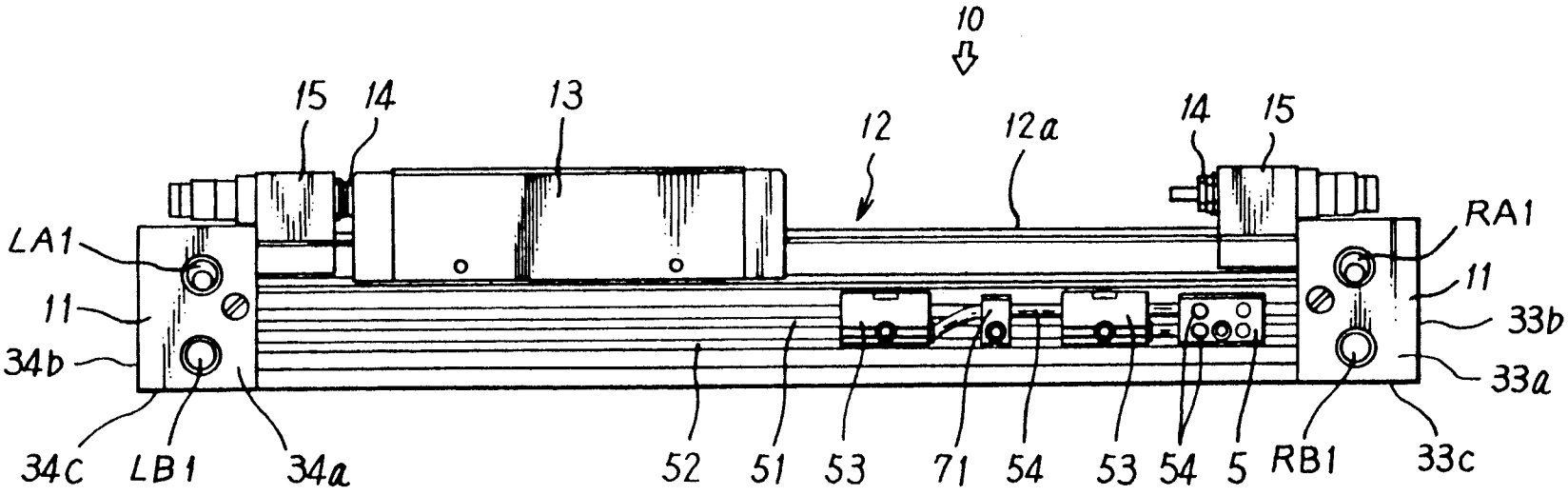
FIG. 2 is a side view of the same rodless cylinder.
Figure 3:
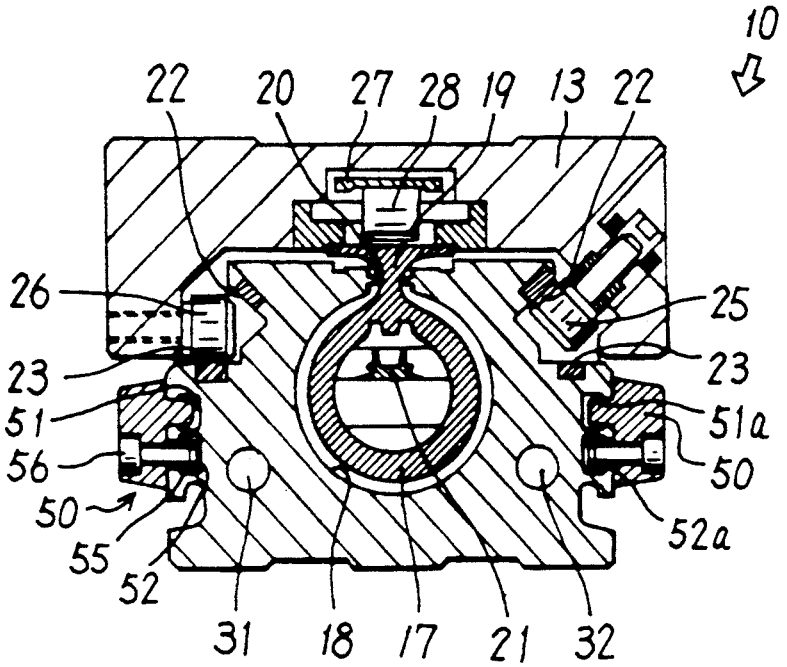
FIG. 3 is a sectional view of the rodless cylinder.

The rodless cylinder 10 which is schematically shown in FIGS. 1 to 3 includes a cylinder body 12, end plates 11 which are attached to the opposite ends of the cylinder body 12, a moving member 13 which is movable longitudinally along a top surface 12*a* of the cylinder body 12, and a stopper mounting block 15 with a stopper 14 for adjustment of stroke range of the moving member 13.

The cylinder body 12 is provided with, in the longitudinal direction thereof, a cylinder bore 18 which accommodates a piston 17 for reciprocating movement therein, a slit 20 which receives a radial link member 19 interlinking the piston 17 and the moving member 13, a seal belt 21 for sealing the slit 20, inclined runway surfaces 22 which are provided on the opposite lateral sides of the cylinder for rolling contact with rollers of the moving member 13, and horizontal runway surfaces 23 which are provided in face to face relation with the inclined runway surfaces 22.

The moving member 13 includes a plural number of rollers 25 and 26 which are rotatably supported at the opposite lateral sides of the moving member 13 in rolling contact with the inclined runway surfaces 22 and horizontal runway surfaces 23, and a guide roller 28 which is journalled on the inner side of the moving member 13 for rolling contact with a dust seal 27 which covers the upper side of the slit 20.

Upon supplying compressed air to one of the pressure chambers on the opposite sides of the piston 17 in the cylinder body 12 of the above-described rodless cylinder, the link member 19 which interconnects the piston 17 and the moving member 13 is moved together with the piston 17, depressing the seal belt 21 to open the slit 20 as it is moved therealong. After passage of the link member 19, the slit 20 is closed by the seal belt 21 again. This basic construction of the rodless cylinder may employ various known constructions of the art.

Figure 6:
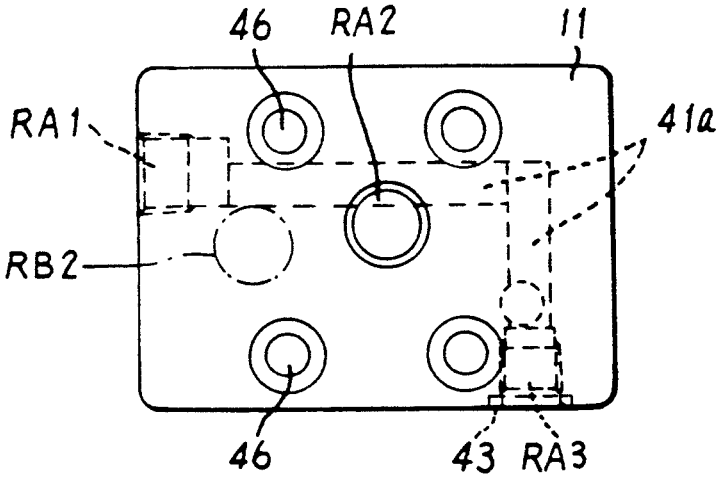
Figure 7:
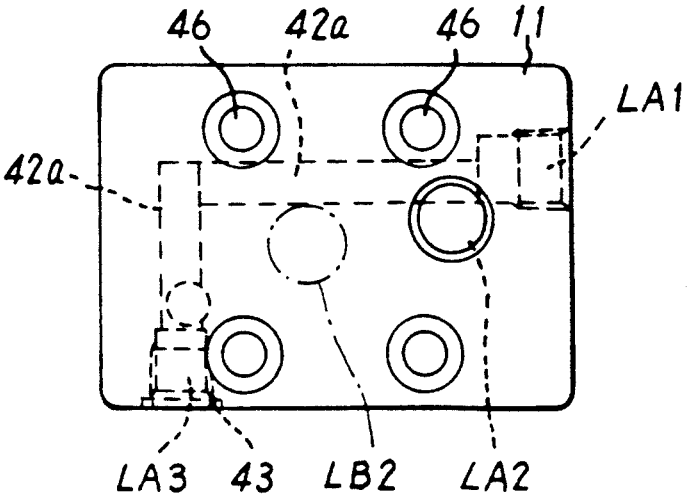
Figure 8:
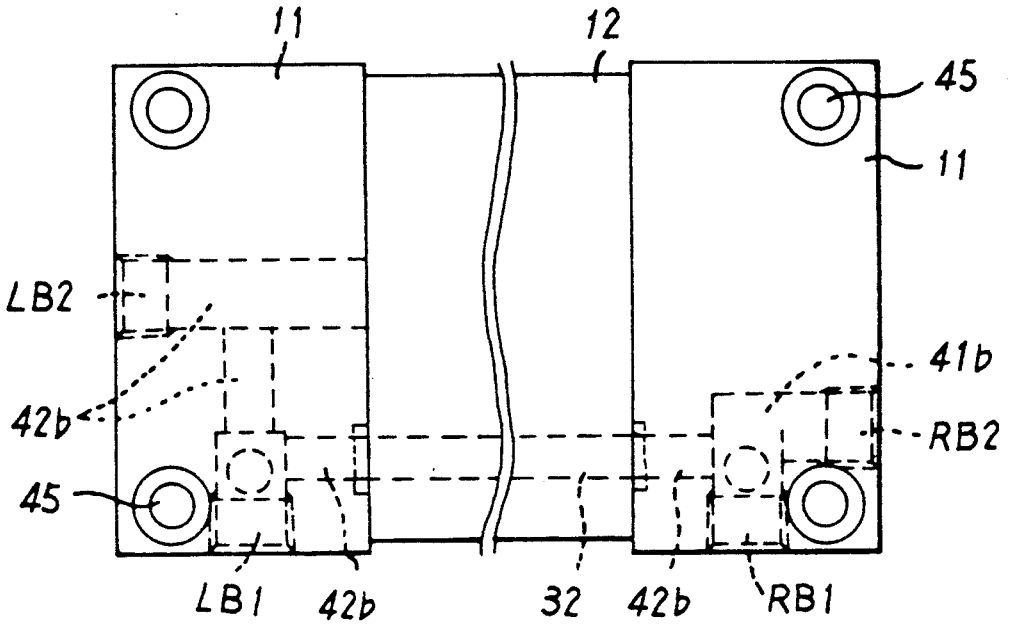
Figure 9:
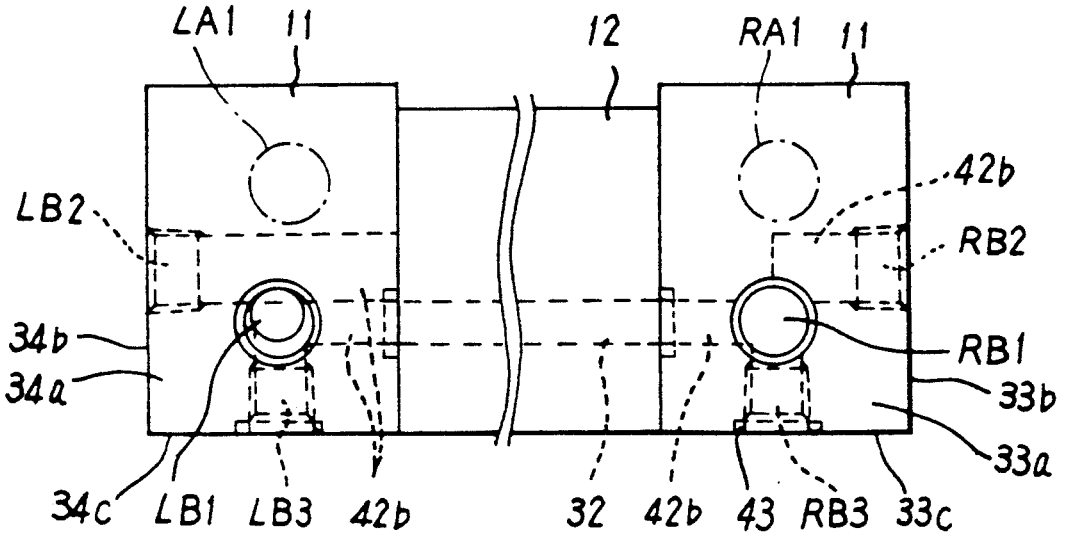
Figure 10:
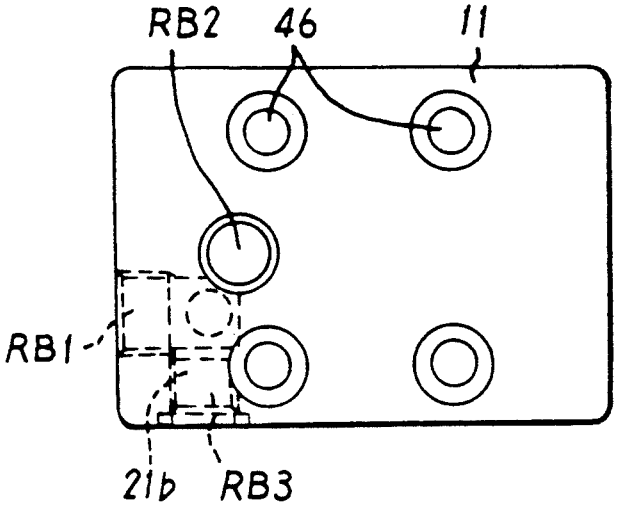
Figure 11:
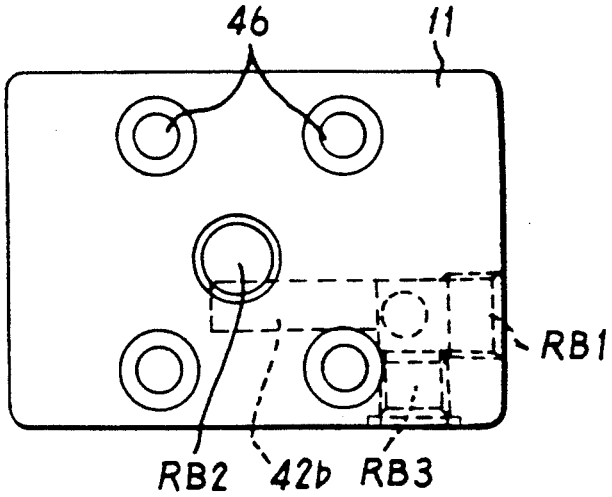
Figure 12:
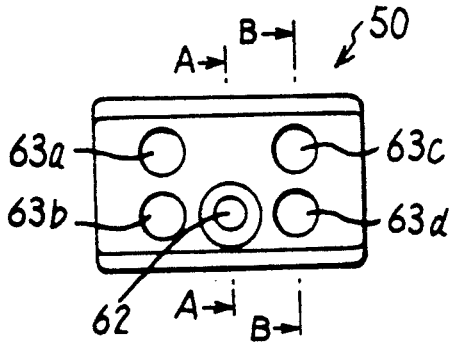
Figure 13:
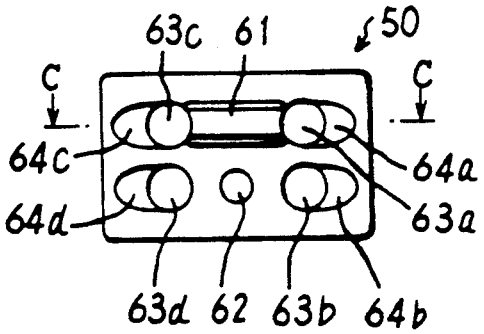
Figure 14:
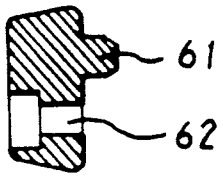
Figure 15:
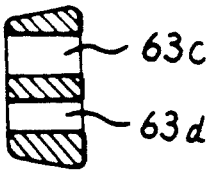
Figure 16:
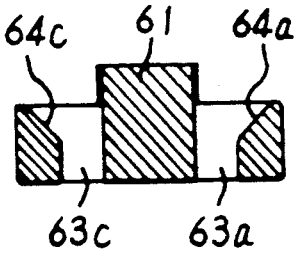

In parallel relation with and on the opposite sides of the cylinder bore 18 which slidably receives the piston 17, the cylinder body 12 of the rodless cylinder is provided with flow passages 31 and 32 to communicate the ports which will be described hereinlater. The end plate 11 which is fixed at one end (right end) of the cylinder body is provided with: right-hand ports RA1 and RB1 opening on one lateral surface 33*a* (see FIG. 2); ports RA2 and RB2 opening on the opposite lateral surface 33*b* (see FIGS. 6 and 10); and ports RA3 and RB3 opening on a lower surface 33*c* (see FIGS. 4 to 11). The other end plate 11 is provided with: left-hand ports LA1 and LB1 opening on one lateral surface 34*a* (see FIG. 2); ports LA2 and LB2 opening on the opposite lateral surface 34*b* (see FIGS. 7 and 11); and ports LA3 and LB3 opening on a lower surface 34*c* (see FIGS. 4 to 11).

Figure 4:
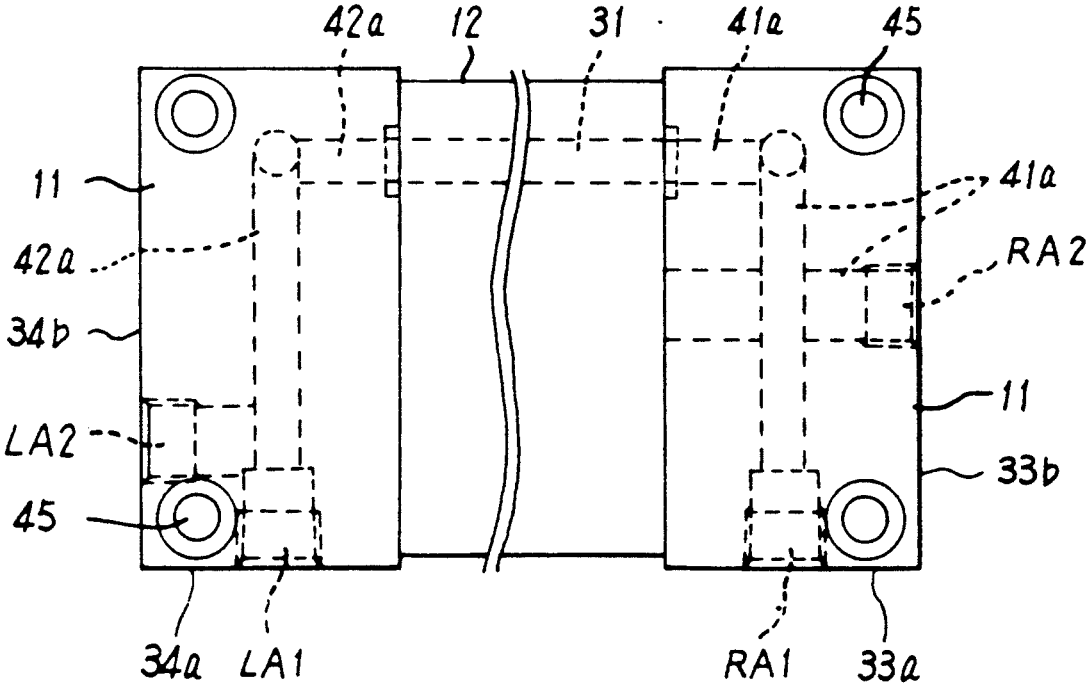
Figure 5:
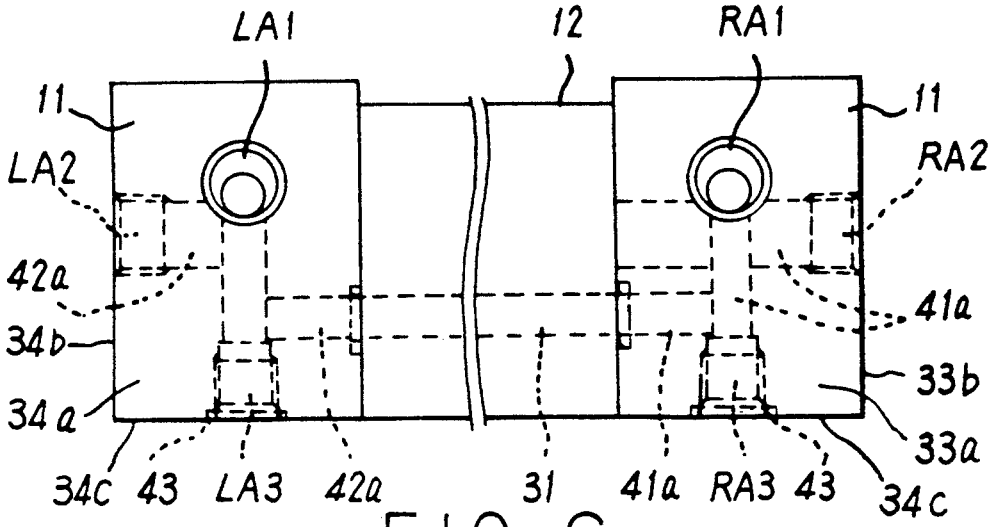

Through flow passages 41*a* and 42*a*, which are bored in the end plates 11, and through the flow passage 31 in the cylinder body 12, the right-hand ports RA1 to RA3 and the left-hand ports LA1 to LA3 are communicated with each other and with one of the pressure chambers which are defined by the piston 17 (with the right-hand pressure chamber in FIG. 4). Further, through flow passages 41*b* and 42*b* which are bored in the end plates 11 and through the flow passage 32 in the cylinder body 12, the right-hand ports RB1 to RB3 and the left-hand ports LB1 to LB3 are communicated with each other and with the other one of the pressure chambers which are defined by the piston 17.

In this instance, the ports RA3 and RB3 and the ports LA1 and LB3 on the lower surfaces 33*c* and 34*c* of the end plates 11 are located such that they can be directly connected to the respective supply ports on the top side of a manifold base, which is not shown, when the rodless cylinder is mounted on the latter. Each one of these ports has a seal packing fitted around its opening.

The reference numeral 45 denotes mounting holes to be used when setting the rodless cylinder in position, and the reference numeral 46 denotes bolt holes for receiving bolts which connect the end plates 11 integrally with the cylinder body 12.

In the above-described embodiment, the end plates 11 are provided with compressed air supply ports on three surfaces, namely, on the lateral side surface 33*a* or 34*a*, end surface 33*b* or 34*b* and bottom surface 33*c* or 34*c*, and the respective supply ports leading to each pressure chamber are communicated with each other. Therefore, a pipe can be connected to any one of the supply ports on the lateral side surface, end surface and bottom surface of the end plates 11, and the rodless cylinder can be turned 180° to connect a pipe to a compressed air source which is located on the back side of the cylinder.

Accordingly, the piping to and from the rodless cylinder can be located in such a way as to preclude its possibilities of obstructing reciprocating movements of an object attached to the moving member, and to use optimum ports in consideration of the posture or setting position of the rodless cylinder or of the position of a compressed air source, thus facilitating the piping job.

In this instance, of course, the ports which are not used for the piping are closed with a plug or other suitable means.

As shown in FIGS. 12 through 16, a wire lead-out member 50 is fitted in a pair of longitudinal grooves 51 and 52 which are formed on a lateral side of the cylinder body 12 as shown in FIG. 2, thereby to guide and hold the outgoing lead wires 54 of the piston position sensor switch 53.

The grooves 51 and 53 are internally provided with broadened large-diameter portions 51*a* and 52*a* to prevent disengagement therefrom of the nuts 55 which are inserted in the grooves for fixing the switch in position. The grooves 51 and 52 are preferably provided with a diverging opening at one end for insertion of the nut.

The switch 53 which detects the piston position is constituted, for example, by a magnetic approaching switch which is adapted to produce an electric signal upon detecting approach of a position detecting magnet which is fixed on the part of the piston, and fixable in a suitable position in the longitudinal direction of the grooves 51 and 52 by means of the bolts 56 and nuts 55, with the lead wires 54 accommodated in the grooves 51 and 52.

The wire lead-out member 50 is integrally formed of an electrically insulating material like a synthetic resin material having a certain degree of resiliency, and provided with a shoe 61 to be loosely fitted in one of the grooves 51 and 52, a mounting hole 62 formed over the other groove, and outlet holes 63*a* to 63*d* formed over the respective grooves for extraction of a lead wire or wires therethrough. The wire lead-out member 50 can be fixed in an arbitrary position in the longitudinal direction of the groove 52 by loosely fitting the shoe 61 in the groove 51 and threading the bolt 56 through the mounting hole 62 into the nut 55 in the large-diameter portion 51*a* of the groove 51. The above-described outlet holes 63*a* to 63*d* which are opened over the grooves 51 and 52 are provided with inclined wall portions 64*a* to 64*d* diverging toward the opposite ends of the lead-out member on the back side thereof.

Accordingly, after fixing the wire lead-out member 50 in a desired position in the longitudinal direction of the groove 52, the lead wire 54 can be drawn out of the cylinder body 12 through one of the outlet holes 63*a* to 63*d* along the corresponding one of the inclined wall portions 64*a* to 64*d* which prevent abrupt bending of the lead wire 54.

The use of the wire lead-out member 50, which can be fixed in an arbitrary position in the longitudinal direction of the groove 52, makes it possible to draw out the lead wire 54 through one of the outlet holes 63*a* to 63*d* whichever is located at a desired position on the cylinder body 12. It follows that the lead wire 54 can be freely drawn out at a suitable non-hindrous position in the longitudinal direction of the cylinder body 12, and can be mounted in position in a facilitated manner, while permitting to alter the mounting position of the switch 53.

The reference numeral 71 in FIG. 2 denotes a holder member which serves to hold the lead wire in position, the holder member 71 being fixed in position by means of a bolt similarly to the switch 53.

The wire lead-out member 50 can be used for collectively drawing out lead wires of up to four switches which are mounted on the grooves 51 and 52 of the cylinder body. For example, it serves to draw out lead wires of a couple of switches collectively as shown particularly in FIG. 2.

The lead wires can be drawn out at a selected position which would not interfere with the reciprocating movement of the moving member similarly to the above-described piping for the pressurized operating fluid, thereby permitting a wide range of selection in determining the positions of the pipes and wires to be led out of the cylinder body.

What is claimed is:

1. A piping and wiring lead-out mechanism for a rodless cylinder having a piston fitted in a cylinder body for reciprocating movement therein and a moving member adapted to slide reciprocatingly along the cylinder body in synchronism with the movement of the piston, said lead-out mechanism comprising:

a port opened in each of end plates which are located at opposite ends of said cylinder to supply fluid pressure to a pair of pressure chambers defined by said piston;

each of said end plates having fluid supply ports opened in a lateral wall, an outer end wall and a lower side wall of each of said end plates to supply fluid pressure separately to each one of said pressure chambers;

said fluid supply ports on each of said end plates being communicated with each other through passages formed in each of said end plates and said cylinder body;

a groove formed longitudinally on a lateral side of said cylinder body to mount and accommodate a switch and switch lead wires thereon; and a wire outlet member having a plural number of lead wire outlet holes in face to face relation with said groove for drawing out lead wires, the wire outlet member being relocatably fixed in said groove at an arbitrary position in the longitudinal direction thereof.

* * * * *